US005078260A

United States Patent [19]

Bensberg et al.

[11] Patent Number: 5,078,260

[45] Date of Patent: Jan. 7, 1992

[54] DEVICE FOR TRANSFERRING FLAT ARTICLES THAT DIFFER IN THICKNESS TO A PACKING MACHINE

[75] Inventors: Wolfgang Bensberg, Düsseldorf; Hans Bömer, Erkrath; Hartmut Klapp, Kaarst, all of Fed. Rep. of Germany

[73] Assignee: Jagenberg Aktiengesellschaft, Dusseldorf, Fed. Rep. of Germany

[21] Appl. No.: 646,445

[22] Filed: Jan. 25, 1991

Related U.S. Application Data

[63] Continuation of Ser. No. 340,879, Apr. 19, 1989, abandoned.

[30] Foreign Application Priority Data

May 3, 1988 [DE] Fed. Rep. of Germany ..... 3814911

[51] Int. Cl.[5] ..... B65G 47/12

[52] U.S. Cl. ..... 198/447; 493/461; 414/788.3; 271/188; 271/216

[58] Field of Search ..... 414/791.4, 788.3, 791.3, 414/791.4, 416; 271/186, 302, 216, 279, 69, 188; 198/374, 447; 493/460, 461

[56] References Cited

U.S. PATENT DOCUMENTS

| | | | |
|---|---|---|---|
| 1,891,286 | 12/1932 | Miersch | 271/188 |
| 2,381,430 | 8/1945 | Belluche | 271/188 X |
| 3,593,624 | 7/1971 | DuFour | 414/791.3 X |
| 3,682,473 | 8/1972 | Kuyt | 414/794.4 X |
| 4,065,117 | 12/1977 | Thorsheim | 414/788.3 X |
| 4,264,255 | 4/1981 | Saro et al. | 414/788.3 |
| 4,349,186 | 9/1988 | Nakamura | 414/416 X |
| 4,354,408 | 10/1982 | Carte | 271/188 X |
| 4,604,851 | 8/1986 | Reist | 198/447 X |
| 4,683,291 | 11/1986 | Buck | 414/788.3 |

FOREIGN PATENT DOCUMENTS

| | | | |
|---|---|---|---|
| 0211174 | 2/1957 | Australia | 198/374 |
| 0525629 | 5/1931 | Fed. Rep. of Germany | 271/216 |
| 2009373 | 9/1971 | Fed. Rep. of Germany . | |
| 2261416 | 12/1975 | Fed. Rep. of Germany . | |
| 8437318 | 8/1986 | Fed. Rep. of Germany . | |
| 045895 | 12/1936 | United Kingdom | 271/216 |

*Primary Examiner*—H. Grant Skaggs
*Assistant Examiner*—James R. Bidwell
*Attorney, Agent, or Firm*—Sprung Horn Kramer & Woods

[57] ABSTRACT

A device for transferring continuously arriving articles, especially folded-bottom boxes lying with their ends that face each other along the direction of travel differing in thickness, to a packing machine, with a mechanism for distributing the articles onto two different conveyor mechanisms, one conveying the articles without rotating them to the upstream side of a merging mechanism and the other extending below the merging mechanism, through a 180° curve, and back to its downstream side and a mechanism for alternately laying off flat articles, especially folded-bottom boxes, from each side of and onto a more or less horizontal merging mechanism that is especially intended for use with a device of the aforesaid type and that has two two-belt conveyor mechanisms that end at approximately the same level on each side of and outside the layoff area. The merging mechanism is a conveyor belt that branches off at an angle from the two conveyor mechanisms and extends to a packing machine. The mechanism for laying off the articles comprises curving the articles at an angle to the direction they are traveling in while they are being laid off.

7 Claims, 2 Drawing Sheets

DEVICE FOR TRANSFERRING FLAT ARTICLES THAT DIFFER IN THICKNESS TO A PACKING MACHINE

This application is a continuation of application Ser. No. 340,879, filed Apr. 19, 1989, now abandoned.

BACKGROUND OF THE INVENTION

The invention concerns a device for transferring continuously arriving articles, especially folded-bottom boxes lying with their ends that face each other along the direction of travel differing in thickness, to a packing machine, with a mechanism for distributing the articles onto two different conveyor mechanisms, one conveying the articles without rotating them to the upstream side of a merging mechanism and the other extending below the merging mechanism, through a 180° curve, and back to its downstream side. The invention also concerns a mechanism for alternately laying off flat articles, especially folded-bottom boxes, from each side of and onto a more or less horizontal merging mechanism that is especially intended for use with a device of the aforesaid type and that has two two-belt conveyor mechanisms that end at approximately the same level on each side of and outside the layoff area.

In stacking flat articles that differ in thickness at their mutually facing ends, rotating some, approximately half, of the articles 180° as they approach the stacking point in order to keep the stacks level is known.

German OS 2 009 373 describes a generic device for stacking periodicals with a distributing station that distributes the periodicals arriving on a conveyor belt onto two different conveyor mechanisms each leading to a different side of a receiving station where the periodicals are stacked and bundled. One conveyor mechanism conveys the periodicals without rotating them to the upstream side of the receiving station and the other extends under the station, through a 180° curve, and back to its downstream side.

A device for creating a level stack of folding boxes is known from German GM 8 437 318. The arriving stream of boxes is also distributed onto two conveyor mechanisms, one extending above the stacking point, through a 180° curve, and back downstream of the stacking point, where it drops the boxes into a stacking shaft.

A drawback to these known devices is that they cannot be employed to continuously pack the articles into shipping cartons vertically as is conventional.

Furthermore, special problems occur when packing folded-flat articles that tend to open up, folded-bottom boxes that are lying flat for example. Experience has demonstrated that the folded-bottom boxes, which tend to open up, cannot, as the periodicals addressed in German OS 2 009 373 can, be allowed to drop freely very far, or, due to the overlapping-folded bottom flaps and sides, be advanced over one another ahead of time with tops or bottoms without problems.

OBJECT OF THE INVENTION

The object of the invention is to improve the generic device to the extent that even folded-flat articles that tend to open up, especially folded-bottom boxes, can be conveyed to a downstream packing machine and that they can there be vertically packed simply into shipping cartons.

This object is attained in accordance with the invention by the improvement wherein the merging mechanism is a conveyor belt 6 that branches off at an angle from the two conveyor mechanisms 3 and 4 and extends to a packing machine. The merging mechanism that branches off at an angle makes it possible to use automatic or semiautomatic packing machines to pack the articles vertically in the shipping cartons. Appropriate packing machines are described for example in German Patent 2 261 416 and German OS 3 801 279.

The two conveyor mechanisms can terminate slightly above the conveyor belt. This measure eliminates problems that occur in conjunction with merging the two streams due to the articles dropping too far.

The branching conveyor belt can be at approximately the same level as the distributor 5. It will accordingly be at the optimum level for packing the boxes in shipping cartons manually.

The two conveyor mechanisms can convey the articles equal distances. This feature is simple in design and allows equal numbers of articles to be distributed onto the two conveyor mechanisms at the same rate, ensuring a uniform overlapping stream of articles on the branching conveyor belt.

The two conveyor mechanisms can travel vertically, whereby the conveyor mechanism that leads to the upstream side of the conveyor belt can have a compensation loop that extends up between the distributor 2 and the conveyor belt. This is a space-saving variation of the version just mentioned.

Another object of the invention is to provide a mechanism that is simple in design and that allows folding boxes that are lying flat and tend to hook onto each other to be laid off one on top of another and one after another from opposite sides without dropping too far.

This object is attained in accordance with the invention by means 14 and 15 of curving the articles 16 at an angle to the direction they are traveling in while they are being laid off.

At least one two-belt conveyor 3 or 4 can have two lateral rods 14.1 and 14.2 extending adjacent to its outlet end pulleys 8.1 and 8.2 more or less above and parallel to the bottom strand of the upper belt 10.1.

The rods can extend into the lay-off area 1.

The mechanism can have vertical guide rollers next to the outlet-end pulleys to force the edges of the articles that are at the side in relation to the direction of travel up or down if they extend more or less above the bottom strand of the upper conveyor belt 10.1.

These three measures simplify the design.

BRIEF DESCRIPTION OF THE DRAWINGS

The invention will now be described in detail with reference to the drawings, which schematically illustrate an embodiment employed to transfer folded-bottom boxes manufactured from blanks in an upstream gluer and lying flat to a packing machine that packs them in shipping cartons.

FIG. 2 is a larger-scale detail of the lay-off area of the conveyor belt that extends at an angle to the direction the articles arrive in.

DETAILED DESCRIPTION OF THE INVENTION

Figure 1:
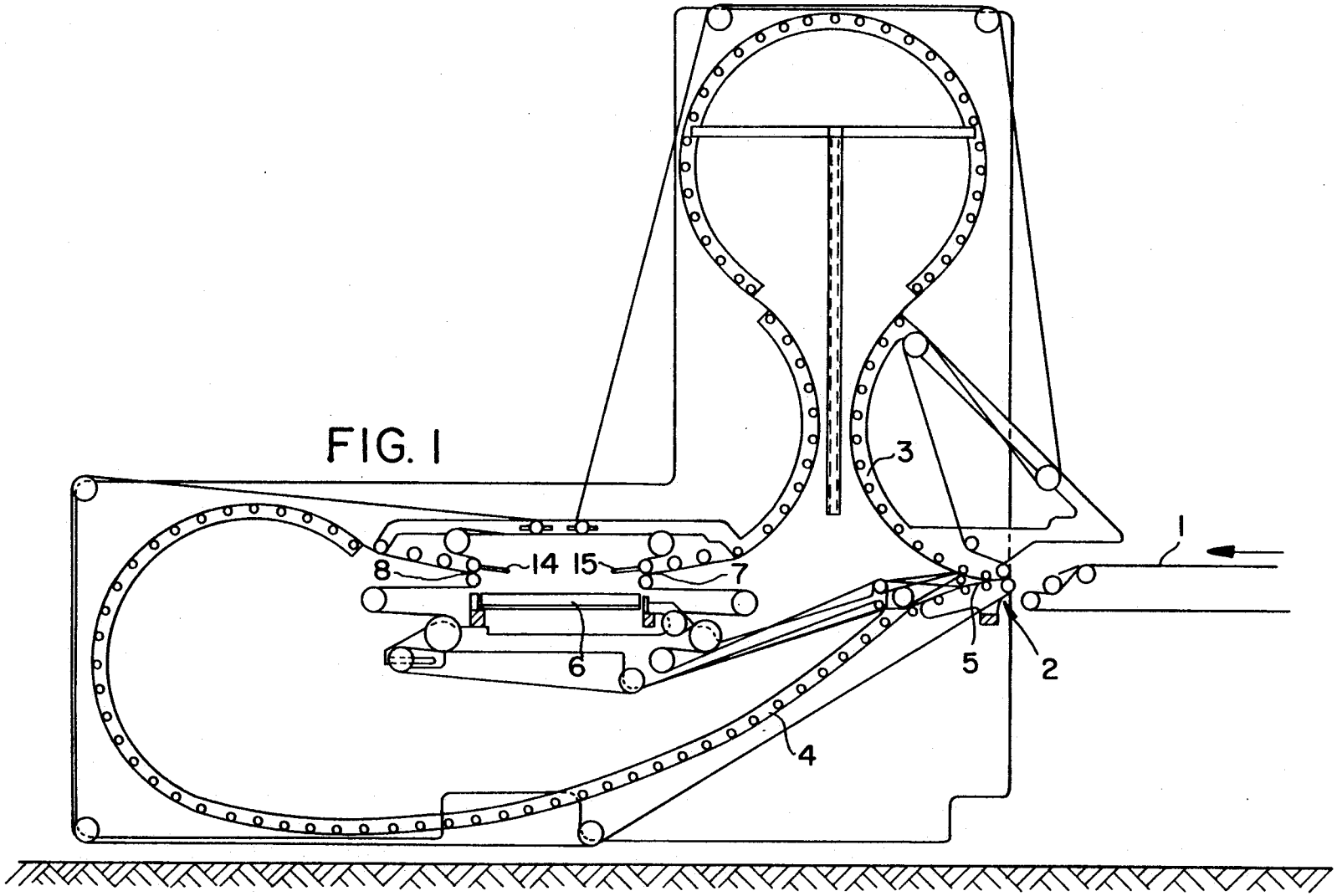
FIG. 1 is a longitudinal section through a transferring device in accordance with the invention.

An incoming conveyor belt 1 extends from an unillustrated folded-box gluer to a transfer device 2 that distributes the incoming boxes to two different revolving conveyor mechanisms 3 and 4, each consisting of a top strand and a bottom strand. Between transfer device 2 and conveyor mechanisms 3 and 4 is a controlled baffle 5 that distributes the boxes alternately to each of the two conveyor mechanisms 3 and 4. A distributing baffle of this type is known from German GM 8 717 500.

Conveyor mechanisms 3 and 4 extend vertically and terminate on each side of and slightly above a horizontal conveyor belt 6 that branches off at approximately the same level as incoming conveyor belt 1 and leads to an unillustrated packing machine. Lower conveyor mechanism 4 extends below conveyor belt 6, through a 180° curve, and back to just above the belt. Upper conveyor mechanism 3 extends, without rotating the boxes, straight to transverse conveyor belt 6 and terminates on the other side of the belt at approximately the same level as lower conveyor mechanism 4. To ensure that both conveyor mechanisms 3 and 4 will convey the boxes to the same extent, conveyor mechanism 3 has a compensation loop.

Transverse conveyor belt 6, which is a revolving-belt conveyor, leads to an unillustrated machine that packs the boxes in shipping cartons.

Figure 2:
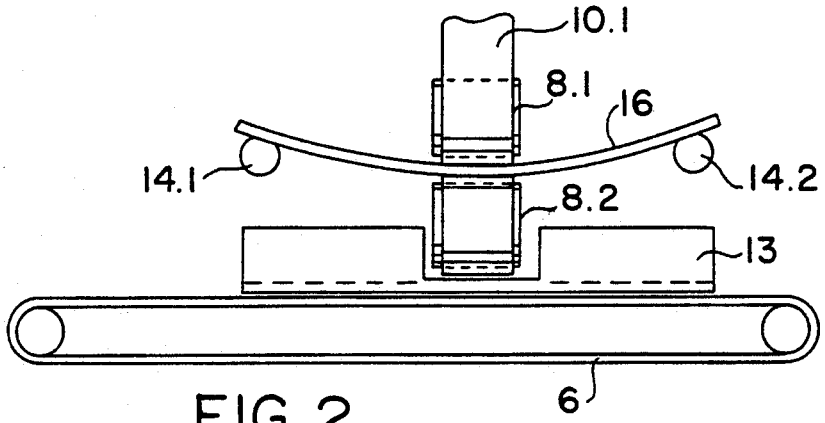
Figure 3:
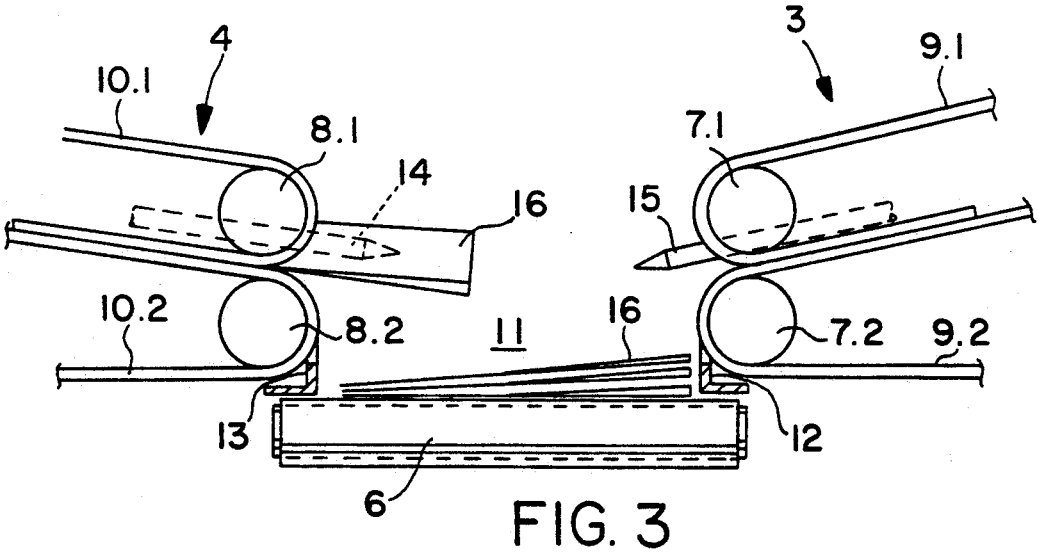
FIG. 3 is a longitudinal section through the lay-off area.

FIGS. 2 and 3 are larger-scale illustrations of the vicinity of the end of conveyor mechanisms 3 and 4 and transverse conveyor belt 6.

The pulleys 7 and 8 on belts 9.1, 9.2 and 10.1, 10.2 respectively, which constitute the end of conveyor mechanisms 3 and 4, are located on each side of and slightly above transverse conveyor belt 6. They can be moved closer to or farther away from each other to adjust the lay-off area 11 between them to different-length folding boxes. Below lower pulleys 7.2 and 8.2 and above transverse conveyor belt 6 are two lateral stops 12 and 13, which are also adjustable. Away from the side of belts 9 and 10, parallel to them, slightly above the lower strand of each upper belt 9.1 and 10 1, and at the end of each conveyor mechanism 3 and 4 are two vertical rollers 121 and 122 or 14 and 15 that extend into lay-off area 11. Rods 14 and 15 force the lateral edges of folding boxes 16 up as they leave conveyor mechanisms 3 and 4 and enter lay-off area 11. This procedure stabilizes them along the direction of travel, preventing the downstream end of each box from tipping down once it is no longer being positioned by belts 9 and 10.

Another embodiment employs, instead of rods 14 and 15, vertical guide rollers on each side of outlet-end pulleys 7 and 8 to force the lateral edges of the boxes up. The circumference of the guide rollers extends to slightly above the lower strand of upper belt 9.1 and 10.1. This relationship can be attained for example by guide rollers with a slightly longer diameter positioned coaxially with outlet-end pulleys 7.1 and 8.1.

How the embodiment just described operates will now be described.

Incoming conveyor belt 1 constantly supplies an overlapping stream of boxes to transfer device 2 from the assembly and pressure-application mechanism of a folded-bottom box gluer. The folded bottoms of boxes 16 are downstream and their tops upstream and up. A specific number (e.g. ten) of folding boxes 16 are obtained from the overlapping stream backed up upstream of transfer device 2 and supplied individually and following one another separated to one of the two conveyor mechanisms 3 and 4 by distributing baffle 5. Once the prescribed number has been supplied, distributing baffle 5 shifts to the other conveyor mechanism 4 or 3. The result is a continuous overlapping stream on transverse conveyor belt 6. This stream is automatically packed in shipping cartons by an unillustrated packing machine.

Since the folding boxes 16 laid off on transverse conveyor belt 6 by lower conveyor mechanism 4 are rotated 180° in relation to the boxes supplied by conveyor mechanism 3, the boxes are always laid off with their thicker end, constituted by the bottom of the box, on different sides of transverse conveyor belt 6. Since the alternating lay-off from the two conveyor mechanisms 3 and 4 makes it impossible to guide folded-bottom boxes 16, which have a tendency to hook onto one another, over the total lay-off area 11, the boxes are maintained at an angle to the direction of travel as they leave conveyor mechanisms 3 and 4 by rods 14.1 and 14.2 or 15. The angle to the direction of travel stabilizes the boxes to the extent that they can be continuously laid off one on top of another with no problems. Stabilization is in particular necessary for the folding-bottom boxes 16 supplied by lower conveyor mechanism 4, which are finally secured only at the top as they leave belts 10.1 and 10.2 and must be supplied with an additional impetus by the upper sides of the boxes downstream of them.

It is understood that the specification and examples are illustrative but not limitative of the present invention and that other embodiments within the spirit and scope of the invention will suggest themselves to those skilled in the art.

What is claimed is:

1. A device for transferring continuously arriving articles, especially folded-bottom boxes lying with their ends that face each other along the direction of travel differing in thickness, from a first continuously moving conveyor belt to a packing machine, including a mechanism for distributing the articles onto two different conveyor mechanisms, one conveying the articles to the upstream side of a merging mechanisms and the other extending below the merging mechanism, through a 180° curve, and back to its downstream side, the improvement wherein one of the conveyor mechanisms has a compensation loop so that the two conveyor mechanisms convey the articles equal distances and wherein the merging mechanism is a continuously moving second conveyor belt disposed at substantially the same level as said first conveyor belt and which branches off at an angle from the two conveyor mechanisms and extends to a packing machine, the articles overlapping on the second conveyor belt and the two conveyor mechanisms terminating at a level slightly above the second conveyor belt.

2. Device as in claim 1, wherein the branching conveyor belt is at approximately the same level as the distributor.

3. Device as in claim 1, wherein the two conveyor mechanisms travel vertically, whereby the conveyor mechanism that leads to the upstream side of the conveyor belt has a compensation loop that extends up between the distributor and the conveyor belt.

4. Device as in claim 1, further comprising means for curving the articles at an angle to the direction they are traveling in while they are being laid off on said second conveyor belt.

5. Device as in claim 4, wherein at least one of said conveyor mechanisms is a tow-belt conveyor that, as the curving means, has two lateral rods extending adjacent to outlet-end pulleys more or less above and parallel to the bottom strand of the upper belt.

6. Device as in claim 5, wherein the rods extend into the lay-off area.

7. Device as in claim 5, including vertical guide rollers next to the outlet-end pulleys to force the edges of the articles that are at the side in relation to the direction of travel up or down if they extend more or less above the bottom strand of the upper conveyor belt.

* * * * *

UNITED STATES PATENT AND TRADEMARK OFFICE

CERTIFICATE OF CORRECTION

PATENT NO. : 5,078,260

DATED : January 7, 1992

INVENTOR(S) : Bensberg et al.

It is certified that error appears in the above-identified patent and that said Letters Patent is hereby corrected as shown below:

| | |
|---|---|
| Title Page | U.S. PATENT DOCUMENTS: After " 4,349,186, 9/ " delete " 1988 " and substitute -- 1982 --, delete " 4,683,291," and substitute -- 4,623,291 -- |
| Title Page | FOREIGN PATENT DOCUMENTS: Delete " 045895 " and substitute -- 0458955 -- |
| Col. 5, claim 5 line 4. | Delete " tow " and substitute -- two -- |

Signed and Sealed this

Seventh Day of September, 1993

Bruce Lehman

*Attest:*

BRUCE LEHMAN

*Attesting Officer*

*Commissioner of Patents and Trademarks*